US011072522B2

(12) United States Patent
Curgy et al.

(10) Patent No.: US 11,072,522 B2
(45) Date of Patent: Jul. 27, 2021

(54) MACHINE INTENDED FOR COOLING AND DRAINING THE CONTENTS OF A METAL BEVERAGE CAN

(71) Applicant: Swinkels Family Brewers France, Mareil-Marly (FR)

(72) Inventors: Antoine Curgy, Lyons (FR); Valentin Ivaldi, Lyons (FR)

(73) Assignee: Swinkels Family Brewers France, Mareil-Marly (FR)

( * ) Notice: Subject to any disclaimer, the term of this patent is extended or adjusted under 35 U.S.C. 154(b) by 0 days.

(21) Appl. No.: 16/496,799

(22) PCT Filed: Feb. 13, 2018

(86) PCT No.: PCT/FR2018/050336
§ 371 (c)(1),
(2) Date: Sep. 23, 2019

(87) PCT Pub. No.: WO2018/178527
PCT Pub. Date: Oct. 4, 2018

(65) Prior Publication Data

US 2020/0391991 A1 Dec. 17, 2020

(30) Foreign Application Priority Data

Mar. 27, 2017 (FR) ..... 1752532

(51) Int. Cl.
*B67D 3/00* (2006.01)
*B67B 7/86* (2006.01)
*B67C 9/00* (2006.01)

(52) U.S. Cl.
CPC ..... *B67D 3/0035* (2013.01); *B67B 7/28* (2013.01); *B67C 9/00* (2013.01); *B67D 3/0083* (2013.01); *B67D 3/0009* (2013.01)

(58) Field of Classification Search
CPC ..... B01F 7/00; B01F 7/002; B01F 7/00725; B01F 7/00733; B01F 7/1605;
(Continued)

(56) References Cited

U.S. PATENT DOCUMENTS 1,892,547 A * 12/1932 Benham ..... B67D 3/0009 222/244
3,926,339 A * 12/1975 Openchowski ..... B67D 3/00 222/83

(Continued)

FOREIGN PATENT DOCUMENTS

CN 2314323 Y 4/1999
CN 1250424 A 4/2000

(Continued)

*Primary Examiner* — Vishal Pancholi
*Assistant Examiner* — Bob Zadeh
(74) *Attorney, Agent, or Firm* — GableGotwals

(57) ABSTRACT

A machine intended for cooling and draining contents of a metal beverage can comprising a refrigerated housing intended to receive a can; a tube projecting into the refrigerated housing and defining a bore. The machine further includes a removable subassembly including a stirrer mounted to slide with respect to the tube to pass through the bore between an upper position in which the stirrer projects
(Continued)

above the upper edge of the tube and a position in which the stirrer is set back with respect to the upper edge of the tube; a duct having an outlet orifice and an inlet orifice communicating with the bore; a plug blocking or opening selectively the outlet orifice of the duct.

16 Claims, 10 Drawing Sheets

(58) Field of Classification Search
CPC .. B67D 3/0009; B67D 3/0012; B67D 3/0061; B67D 1/004; B67D 1/0082; B67D 1/0456; B67D 1/0857; B67D 1/0861; B67D 1/0869; B67D 3/0083; B67D 3/0035; B67D 3/02; B67D 3/0019; B67D 3/0025; B67D 3/0054; B67D 3/008; B67D 1/0889; B67D 1/0891; B67B 2007/303; B67B 2007/306; B67B 7/32; B67B 7/34; B67B 7/36; B67B 7/30; B67B 7/26; B67B 7/28; B67C 9/00
See application file for complete search history.

(56) References Cited

U.S. PATENT DOCUMENTS

| | | | | |
|---|---|---|---|---|
| 5,199,278 | A * | 4/1993 | Cocchi | A23G 9/086 366/149 |
| 2002/0089894 | A1* | 7/2002 | Parlor, Sr. | B01F 7/1695 366/245 |
| 2005/0077318 | A1* | 4/2005 | Macler | B67D 3/0009 222/81 |
| 2012/0204578 | A1* | 8/2012 | Leavitt | F25D 5/02 62/4 |
| 2014/0158710 | A1* | 6/2014 | Lunn | A23G 9/045 222/63 |
| 2019/0247810 | A1* | 8/2019 | Brandt | B01F 3/10 |

FOREIGN PATENT DOCUMENTS

| | | | |
|---|---|---|---|
| CN | 1495104 | A | 5/2004 |
| CN | 1543429 | A | 11/2004 |
| CN | 102662943 | A | 1/2013 |
| DE | 29710597 | U1 | 9/1997 |
| WO | WO 2007081208 | A1 | 7/2007 |

* cited by examiner

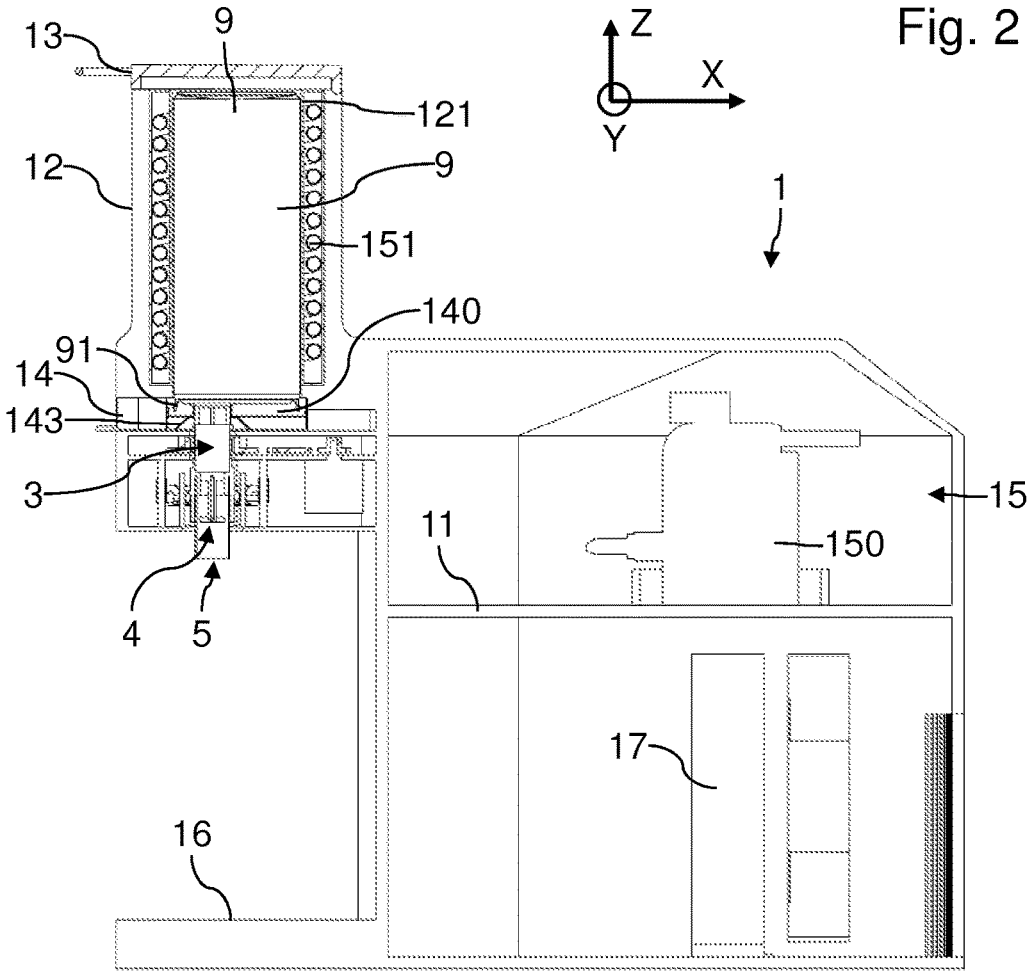
Fig. 2
Fig. 3
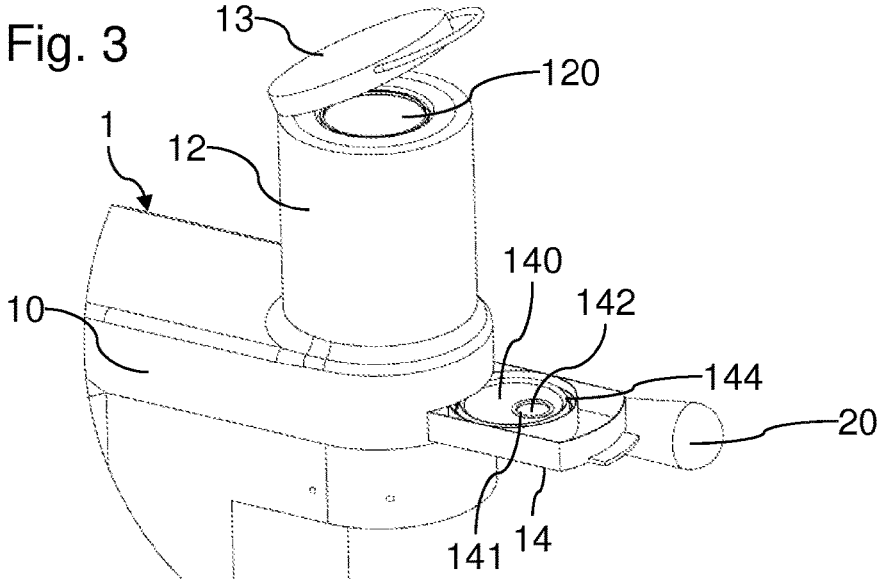

Fig. 4
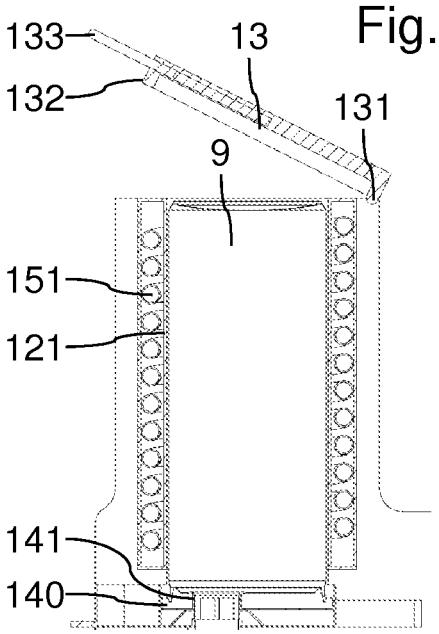
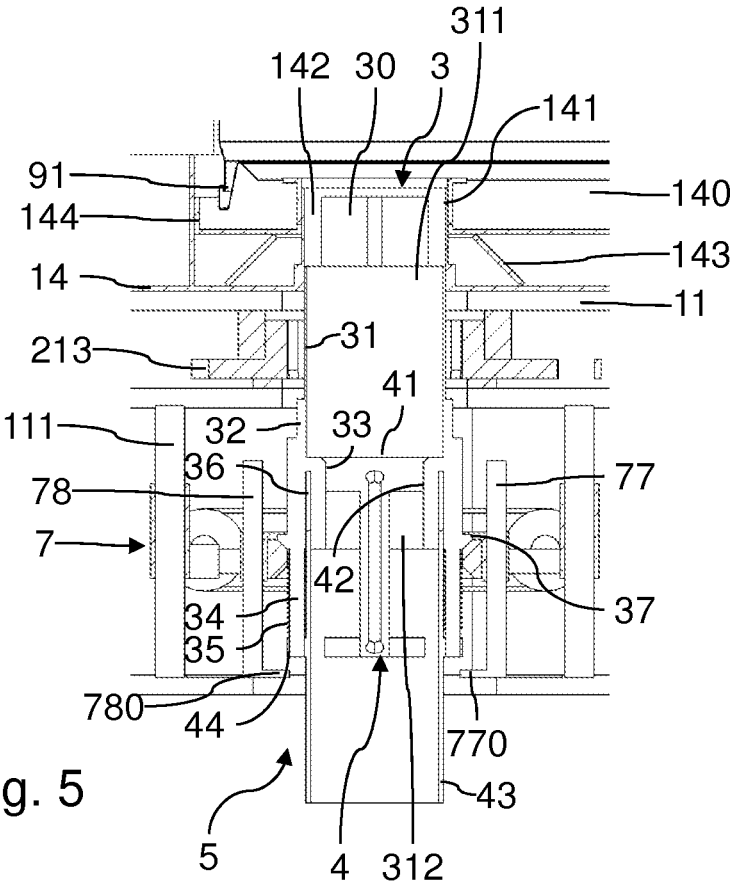
Fig. 5

Fig. 10
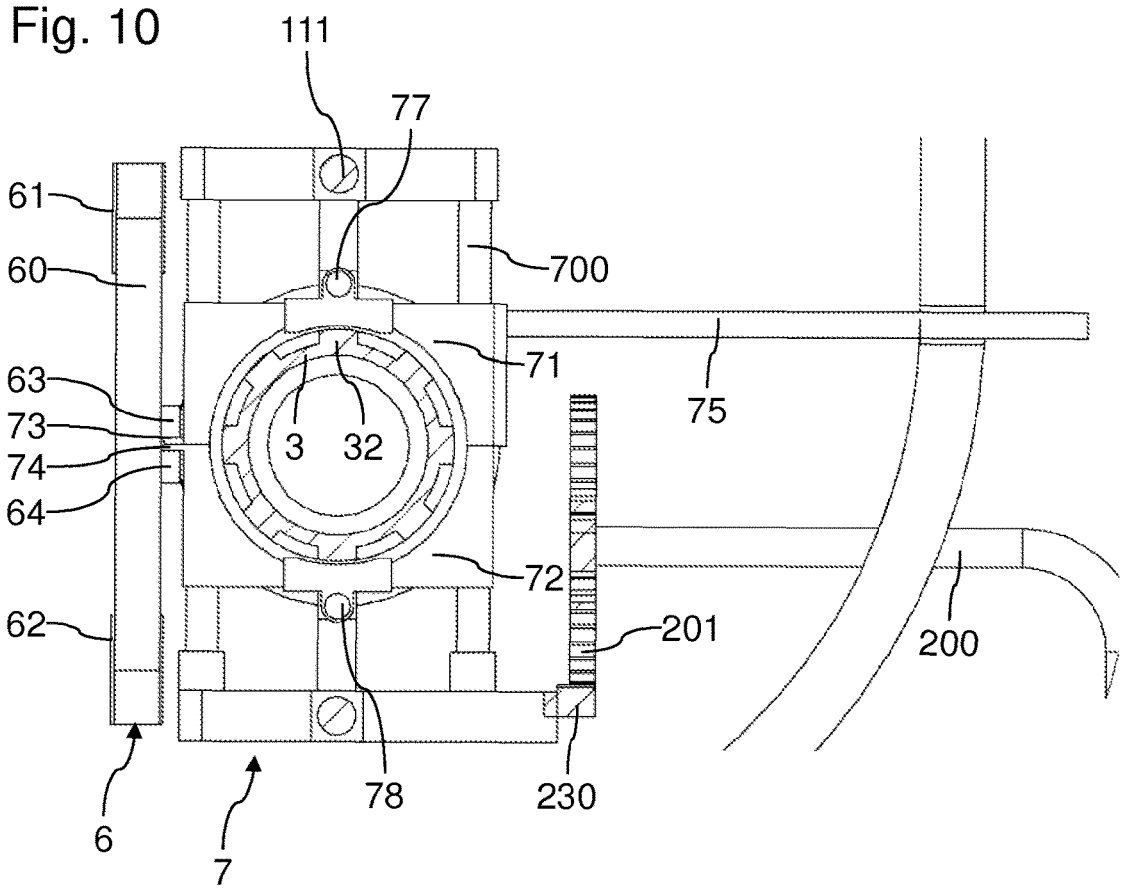
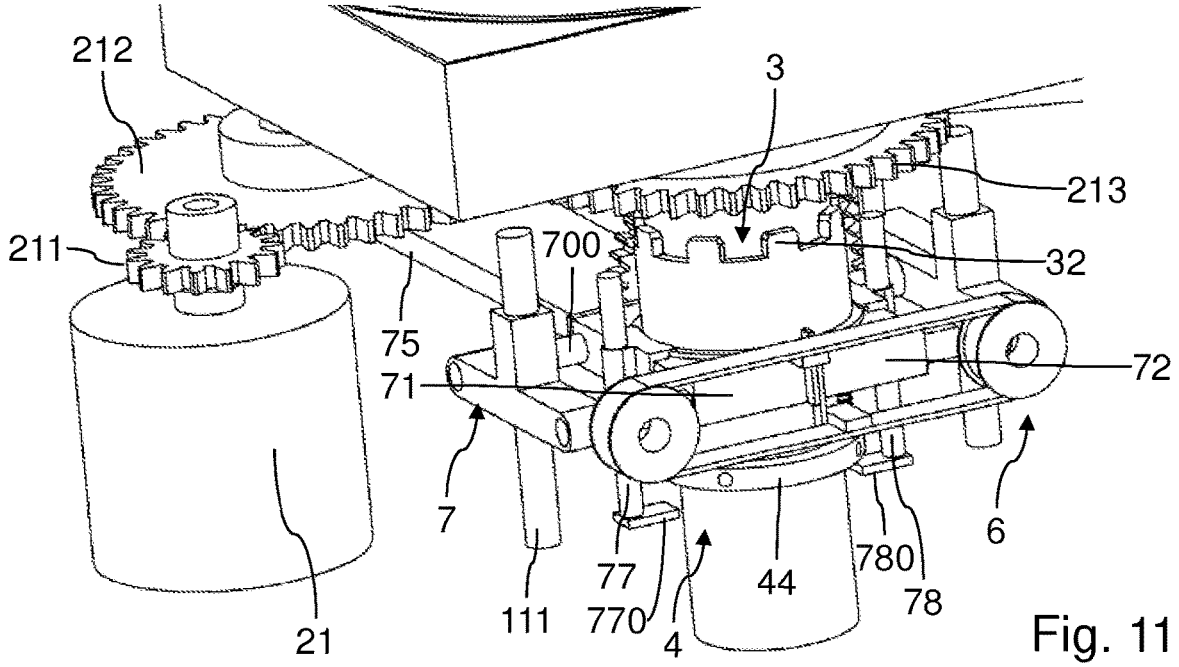
Fig. 11

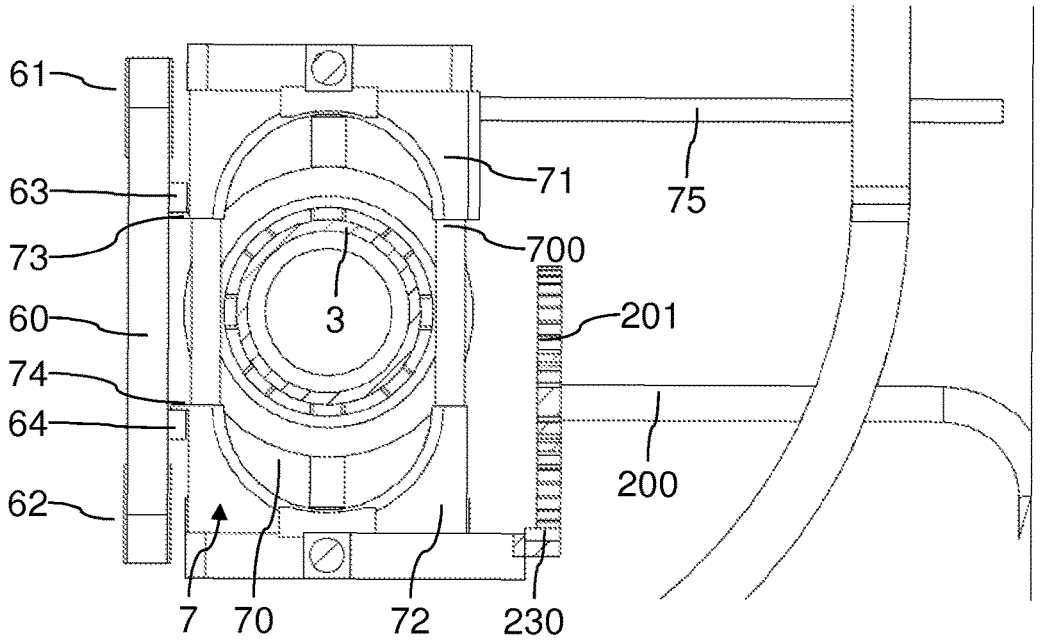
Fig. 12
Fig. 13
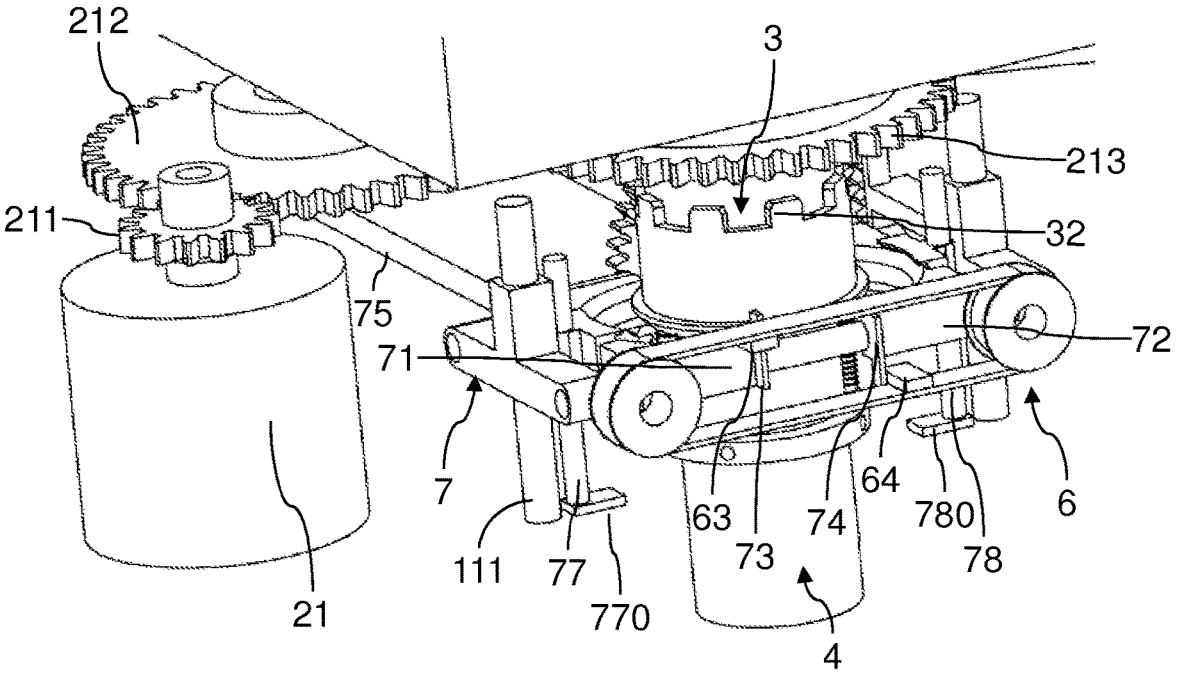

MACHINE INTENDED FOR COOLING AND DRAINING THE CONTENTS OF A METAL BEVERAGE CAN

CROSS-REFERENCE TO RELATED APPLICATIONS

This application is the United States National Phase of PCT Patent Application No. PCT/FR2018/050336 filed on 13 Feb. 2018, which claims priority to French Patent Application No. 1752532 filed 27 Mar. 2017, both of which are incorporated herein by reference.

The invention relates to the consumption of drinks packaged in metal cans, and in particular to the refrigeration and dispensing of such drinks.

During festive events, users can make use of a large number of different beverage cans. In order to be able to dispense the beverages contained in such cans in optimum temperature conditions, the user must first store all the cans which are to be consumed in a refrigerator. The space available in such a refrigerator is often insufficient and does not allow all the cans which are to be consumed to be stored. Given the thermal inertia of the beverage, the cooling time for new cans placed in the refrigerator is also too long to allow all the cans to be consumed in optimum coldness conditions.

It is known to make use of refrigerating taps for beer consumption. Such taps enable beer to be drawn from a cask, cooled, and poured into a glass. However, such taps have a certain number of disadvantages. On the one hand, they are bulky and require a pressurized gas canister to be made available. On the other hand, once a cask has been opened, it must be consumed quickly or else the beer contained in it will deteriorate quickly. Moreover, such beer taps do not make it possible to change beverages easily before a cask has been finished.

The object of the invention is to overcome one or more of these disadvantages. The object of the invention is in particular to make it possible to consume beverages from different cans in optimum coldness conditions even when the cans have not been cooled beforehand. The subject of the invention is thus a machine intended for cooling and draining the contents of a metal beverage can, as defined in the attached claim 1.

The subject of the invention is also the alternative embodiments of the dependent claims. A person skilled in the art will understand that each of the features of the dependent claims can be combined independently with the features of an independent claim without in so doing constituting an intermediate generalization.

Other features and advantages of the invention will become clear from the description made below, by way of example and implying no limitation, with reference to the attached drawings, in which:

FIG. 2 is a front view in section of the machine in FIG. 1;

FIG. 3 is a perspective view of a detail of the machine in FIG. 1;

FIG. 4 is a front view in section of the machine at the level of a can housing;

FIG. 5 is a front view in section of the machine at the level of a removable subassembly;

FIGS. 10 to 13 are plan perspective views of the machine at the level of the removable subassembly, in different configurations;

The invention proposes a machine intended for cooling and draining the contents of a metal beverage can. The machine has a refrigerated housing for receiving a can and cooling it via its periphery. The machine has a tube projecting into the refrigerated housing so as to be able to penetrate a top end of the can and access the beverage contained in the can. The tube defines a bore intended for draining the beverage contained in the can. The machine has a subassembly which can be removed so that it can be cleaned easily and the taste of one beverage prevented from being spoilt by the taste of a previous beverage. The removable subassembly has a stirrer mounted so that it can slide with respect to the tube so as to be able to pass through the bore. In an upper position, the stirrer is situated above the upper edge of the tube so as to be able to stir the beverage and obtain forced thermal convection in the can. The cooling time of the beverage inside the can is thus substantially reduced. In a lower position, the stirrer is situated below the upper edge of tube, which makes it possible to prevent it from being, damaged when the can is put in place with the top end being pierced by the tube. A duct of the subassembly communicates with the bore of the tube. This duct is selectively blocked or opened by a plug. The beverage can thus initially be held in the can while it is being cooled and stirred, and then be drained to the outside.

Figure 1:
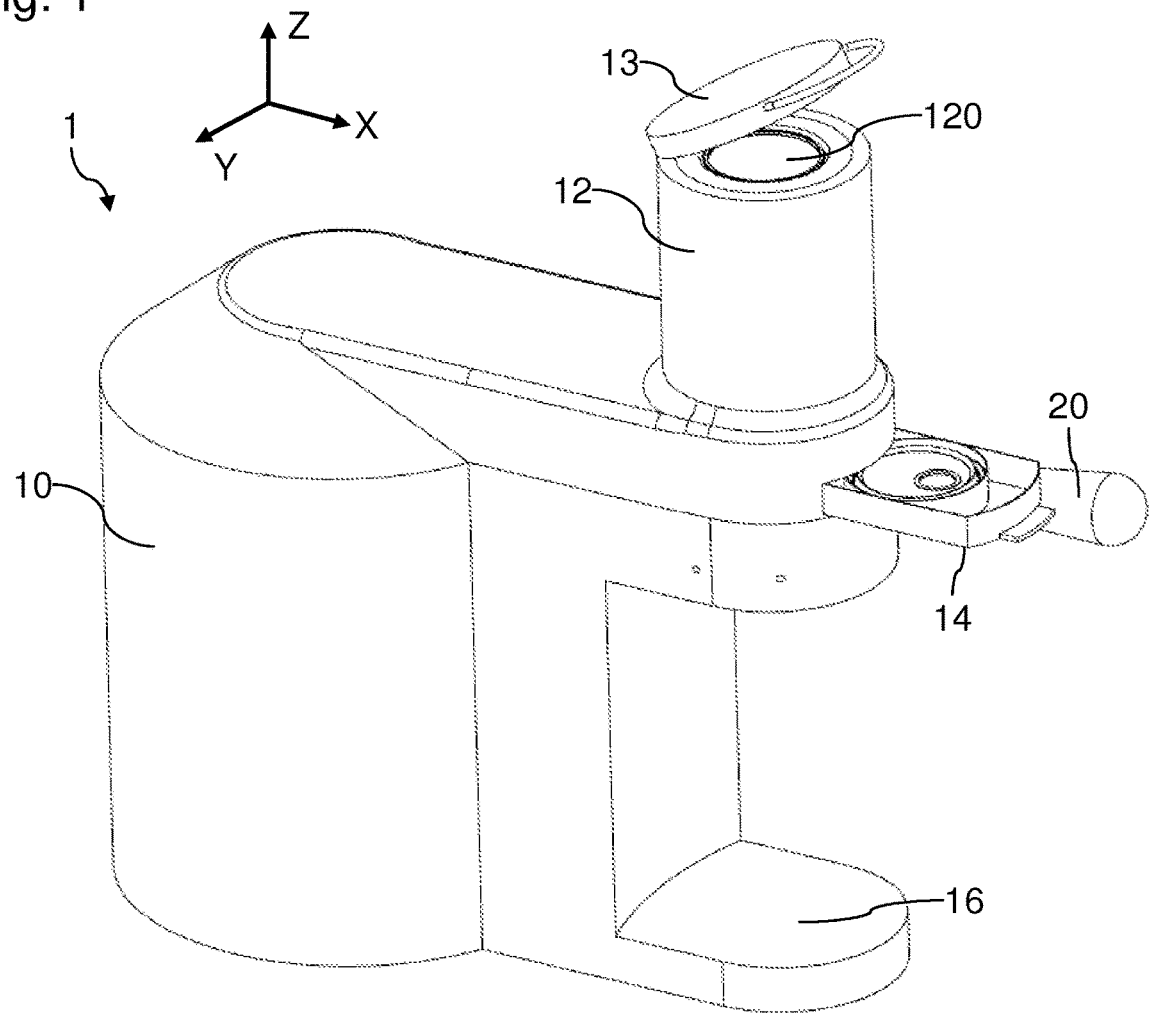
FIG. 1 is a perspective view of an example of an embodiment of a machine according to the invention.

FIG. 1 is a perspective view of an example of an embodiment of a machine 1 according to the invention. For the sake of legibility, a system of axes is illustrated in FIG. 1. The axis X will define a longitudinal direction of the machine 1, the axis Y will define a transverse direction of the machine 1, and the axis Z will define a vertical direction of the machine 1.

The machine 1 has a casing 10 concealing most of its components. The machine 1 has a can-reception unit 12. The can-reception unit 12 has an upper opening providing access to a refrigerated housing 120. The refrigerated housing 120 is intended to receive a can containing a beverage. A cover 13 makes it possible to selectively cover or free the upper opening in order to block or open access to the refrigerated housing 120. The machine 1 has a receiving stand 16 for a glass into which the refrigerated beverage is to be drained. The machine 1 here also has a lever 20 intended to move a beverage stirring and draining subassembly. The machine 1 here also has a slide 14 which is advantageously intended for the withdrawal of a seal and a tube with respect to the remainder of the machine 1.

FIG. 2 is a front view in section of the machine 1 in FIG. 1. The machine 1 comprises a refrigeration device 15. The refrigeration device 15 here includes a compressor 150 and cooling tubes 151. The compressor 150 is housed inside the casing 10 and is fixed to a frame 11 of the machine 1. The compressor 150 circulates a refrigerant fluid through the cooling tubes 151 in a manner known per se. Other alternative cooling devices can be envisaged, for example Peltier module cooling devices. The cooling tubes 151 are wound around a cylindrical wall 121, defining the refrigerated housing 120. The generatrix of the cylindrical wall 121 is here vertical.

A can 9 is here housed in the refrigerated housing 120. The can 9 is here arranged in the housing 120 with its top end facing downward. The top end of the can 9 has a collar 91 in contact with a seal 140 carried by the slide 14. The seal 140 is here returned elastically upward by a spring 143.

The machine 1 here comprises a subassembly 5 including a stirrer 3 and a plug 4. The stirrer 3 is positioned opposite the top end of the can 9. The subassembly 5 is arranged vertically above the receiving stand 16. The machine 1 furthermore has an electronic card 17 which is here housed beneath the casing 10. The electronic card 17 carries a control circuit for the refrigeration device 15 and a drive motor for the stirrer 3.

FIG. 3 is a perspective view of a detail of the machine 1 at the level of the reception unit 12 and the slide 14. As illustrated, the slide 14 is mounted so that it can slide with respect to the casing 10 in the longitudinal direction. The slide 14 has a support 144 in which the seal is housed. The support 144 is here mounted so that it can slide with respect to the slide 14 in a vertical direction. The seal 140 is, for example, made from an elastomer. The support 144 is stressed by the spring 143, placed in between this support 144 and the slide 14. The spring 143 takes the form of, for example, a so-called Belleville washer. The slide 14 has a vertical tube 141. The tube 141 passes through the seal 140 and is encircled by this seal 140. The tube 141 defines a bore 142. When the slide 14 is slotted into the machine 1, the tube 141 projects into the refrigerated housing 120 so as to be able to interfere with the top end of the can 9. The use of a removable slide 14 makes it possible, for example, to rinse the seal 140 and the tube 141.

FIG. 4 is a front view in section of the machine 1 at the level of the refrigerated housing 120. The tube 141 is advantageously designed to pierce the top end of the can 9 when the latter is pushed into the refrigerated housing 120. For this purpose, the upper edge of the tube 141 advantageously has the form of a blade. The top end of the can 9 can also advantageously have a perforation in the shape of the tube 141 to facilitate the piercing.

The machine 1 advantageously has the cover 13 intended to selectively cover the upper opening of the refrigerated housing 120. In the covered position, the cover 13 promotes maintenance of a low temperature in the refrigerated housing 120.

The cover 13 has a first end 131 via which it is mounted so that it can pivot with respect to the casing 10 in a horizontal axis. The cover 13 has a second end 132 equipped with a gripping means 133. The cover 13 can thus be pivoted between a position in which it covers the upper opening of the refrigerated housing 120 and a position in which it allows access to this refrigerated housing 120 for the introduction of a can 9. The cover 13 advantageously has a part which projects into the refrigerated housing 120 when force is applied to the gripping means 133 to cause the cover 13 to cover the refrigerated housing 120. When a user applies force to the gripping means 133 to cover the refrigerated housing 120, the projecting part presses against the can 9 in order to compress it against the tube 141 and thus obtain the piercing of the top end of the can 9. A clip-fastening mechanism can be provided so that the cover 13 can be held independently in the position covering the refrigerated housing 120.

After the top end of the can 9 has been pierced, the sealing is thus ensured both by its contact with the (elastically deformable) seal 140 and by its contact with the tube 141.

The spring 143 assists the extraction of the can 9 when the cover 13 is opened by exerting an upward force on the can 9 via the seal 140. The spring 143 also assists the sealing of the system by maintaining the contact between the can 9 and the seal 140.

FIG. 5 is a front view in section of the machine 1 at the level of its removable subassembly 5. The stirrer 3 forms the upper part of the removable subassembly 5, the plug 4 forming the lower part of this removable subassembly 5.

The stirrer 3 has fins 30 intended to create a movement of the beverage inside the can 9 when these fins 30 are driven in rotation about a vertical axis. The fins 30 are here fixed to the end of a shaft 31. The shaft 31 is here a hollow shaft defining a duct which communicates with the bore 142. The shaft 31 is here mounted so that it can slide in the vertical direction with respect to the tube 141. The fit between the shaft 31 and the tube 141 is advantageously such that the beverage cannot flow between the periphery of the shaft 31 and the tube 141. The hollow shaft 31 has an outlet orifice 312 at its lower part for draining the beverage, and an inlet orifice 311 at its upper part for receiving the beverage originating from the can 9.

The stirrer 3 is mounted so that it can slide in the tube 141 in the vertical direction. The stirrer 3 can thus slide in order to pass through the bore 142 as far as an upper position (not illustrated) in which it projects above the upper edge of this tube 141. In this position, the fins 30 are thus immersed in the beverage inside the can 9. When the fins 30 are driven in rotation, they can thus create a forced convention in the beverage. The stirrer 3 can slide as far as an intermediate position illustrated in FIG. 5 in which the fins 30 are set back with respect to the upper edge of the tube 141. In this position, the fins 30 are protected by the tube 141 from interference with the top end of the can 9 which can cause damage to them.

Teeth 32 are formed on the outer periphery of the hollow shaft 31. The teeth 32 enable the stirrer 3 to be driven in rotation about the vertical axis, as detailed below.

The plug 4 is mounted so that it can slide vertically with respect to the stirrer 3. The plug 4 has in particular a tubular part 43 which is guided in sliding fashion in a throat 36 of the stirrer 3. The plug 4 furthermore has an outer collar 44 which is guided so that it can slide vertically via vertical shafts 34 integral with the stirrer 3. Return springs 35 are here positioned around the shafts 34 and apply a downward return force to the plug 4, applied to the collar 44.

The plug 4 has a piston 41. The piston 41 has a radial surface 42. In the blocking position, the radial surface 42 comes into contact with a bearing surface 33 of the stirrer 3 so as to obstruct the flow of the beverage. In a release position, the piston 41 is at a distance from the bearing surface 33 such that the beverage can flow along its radial surface 42 and then flow along the bearing surface 33 of the stirrer 3. In the release position, the beverage flows along the fins 30 and passes through the duct 31 and the tubular part 43 of the plug 4. The beverage then drains into a glass positioned on the stand 16. The flow of the beverage is generally facilitated by the presence of pressurized gas inside the can 9. The tubular part 43 here forms an extension of the hollow shaft 31 so as to prevent splashes of beverage below the subassembly 5.

The machine 1 has a gear system driven by a motor 21 and capable of driving the stirrer 3 in rotation. The gear system comprises in particular a toothed wheel 213. The toothed wheel 213 has outer teeth and inner teeth. When the stirrer 3 is in the upper position, the teeth 32 of the stirrer engage with the inner teeth of the toothed wheel 213. In this position, the stirrer 3 is thus driven in rotation by the wheel 213. In the intermediate position of the stirrer 3, the teeth 32 are positioned below the wheel 213 and no longer engage with the inner teeth of the wheel 213. The stirrer 3 is then disengaged with the wheel 213.

The machine 1 moreover has a support 7 which is configured so as to define the vertical position of the subassembly 5 (in particular of the stirrer 3) and is configured so as to guide the stirrer 3 in rotation about a vertical axis. The support 7 is mounted so that it can slide along a vertical axis on shafts 111 integral with the frame 11. The support 7 moreover carries stops 77 and 78 which are intended to actuate the opening of the plug 4. The structure of the support 7 will be described in detail below.

Figure 6:
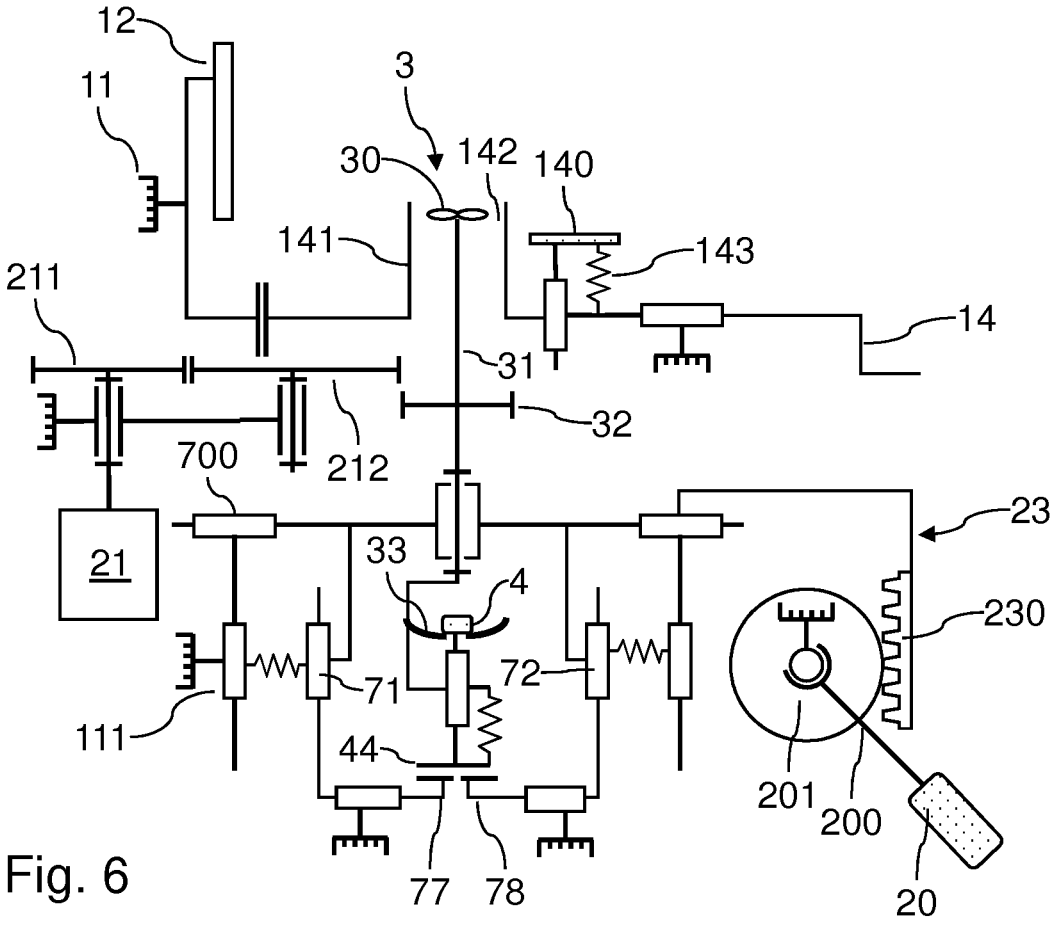
FIG. 6 is a kinematic diagram of different components of the machine.

FIG. 6 is a kinematic diagram of a certain number of components of the machine 1. The unit for receiving the can 12 is integral with the frame 11. The slide 14 is mounted so that it can slide in the longitudinal direction with respect to the frame 11. The seal 140 is mounted so that it can slide in the vertical direction with respect to the slide 14 and is returned elastically to an upper position via the spring 143.

The motor 21 is fixed to the frame 11. The rotor of the motor 21 drives a toothed wheel 211 in rotation about a vertical axis. Another intermediate toothed wheel 212 is here mounted in rotation with respect to the frame 11 about a vertical axis. The intermediate toothed wheel 212 is driven in rotation by the toothed wheel 211.

The stirrer 3 is mounted so that it can slide vertically with respect to the frame 11 and with respect to the slide 14. Depending on the vertical position of the stirrer 3, the teeth 32 integral with the shaft 31 are driven in rotation by the toothed wheel 213 or disengaged from the wheel 213. For the sake of simplicity, the toothed wheel 213 is not illustrated and the kinematic illustration in FIG. 6 shows direct meshing of the teeth 32 with the intermediate toothed wheel 212. The fins 30 of the stirrer 3 are configured so as to pass through the bore 142 of the tube 141.

The support 7 has horizontal shafts 700. The horizontal shafts 700 are mounted so that they can slide in a vertical direction on the shafts 111. The support 7 comprises two jaws 71 and 72 which are mounted so that they can slide in the longitudinal direction on the horizontal shafts 700. As illustrated, the jaws 71 and 72 are returned elastically to a position in which they are applied flat against each other by means of springs (with no reference numerals). In the position in which the jaws 71 and 72 are applied flat against each other, the jaws 71 and 72 define the vertical position of the stirrer 3 and guide the stirrer 3 in rotation about a vertical axis. By moving the jaws 71 and 72 apart from each other, a release position for the subassembly 5 is defined.

The machine 1 moreover has a mechanism 23 for vertical displacement of the support 7. The mechanism 23 has a vertical rack 230 which is integral with the support 7. The lever 20 is mounted so that it can pivot about a transverse axis with respect to the frame 11. The lever 20 has a shaft 200 and a toothed wheel 201 fixed to the shaft 200. The axis of pivoting of the lever 20 coincides with the axis of the toothed wheel 201. The toothed wheel 201 engages with the rack 230. Thus, when the lever 20 pivots, the support 7 and hence the stirrer 3 are driven in translation in a vertical direction. By lifting the lever 20, the stirrer 3 is placed in its upper position, with the fins 30 projecting above the upper edge of the tube 141. By maintaining the lever 20 at an intermediate level, the stirrer 3 is positioned in its intermediate position, the fins 30 then being set back with respect to the upper edge of the tube 141. By lowering the lever 20, the stirrer is in its lower position, corresponding to an opening of the plug 4.

In the configuration illustrated in FIG. 6, the plug 4 interacts with the bearing surface 33 in order to block the flow through the hollow shaft 31, which corresponds to the upper position and to the intermediate position of the stirrer 3. In the lower position of the stirrer 3 and in the position where it is guided by the support 7, the collar 44 interferes with the stops 77 and 78, which moves the piston of the plug 4 away from the bearing surface 33, releasing the flow through the hollow shaft 31.

Figure 7:
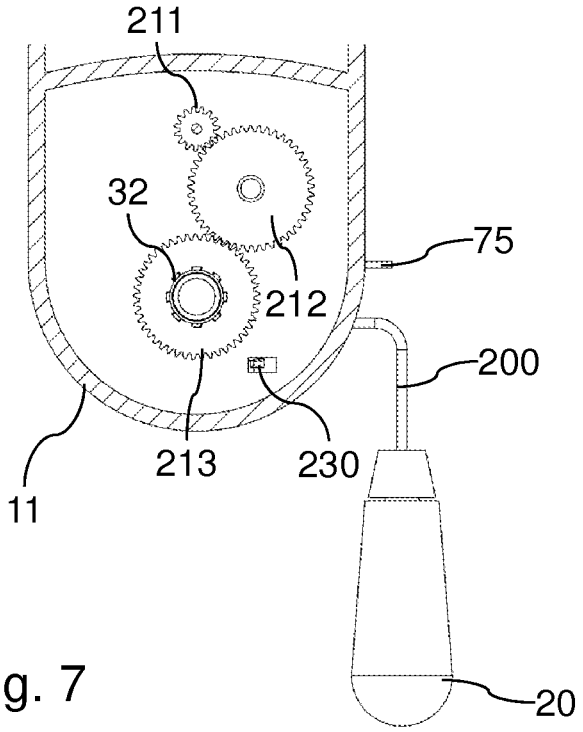
FIG. 7 is a plan view in section of the machine at the level of the gear system.

FIG. 7 is a plan view in section of the machine 1 at the level of the gearing. The stirrer 3 is here in its upper position. The teeth 32 then engage with the inner teeth of the toothed wheel 213. When the toothed wheel 211 is driven in rotation by means of the motor 21, the stirrer 3 is driven in rotation by means of the teeth 32, the toothed wheel 213, and the intermediate toothed wheel 212. Trials have shown that it was possible to determine that the beverage in a can 9 can be cooled with a duration of stirring between thirty and one hundred and twenty seconds.

Figure 8:
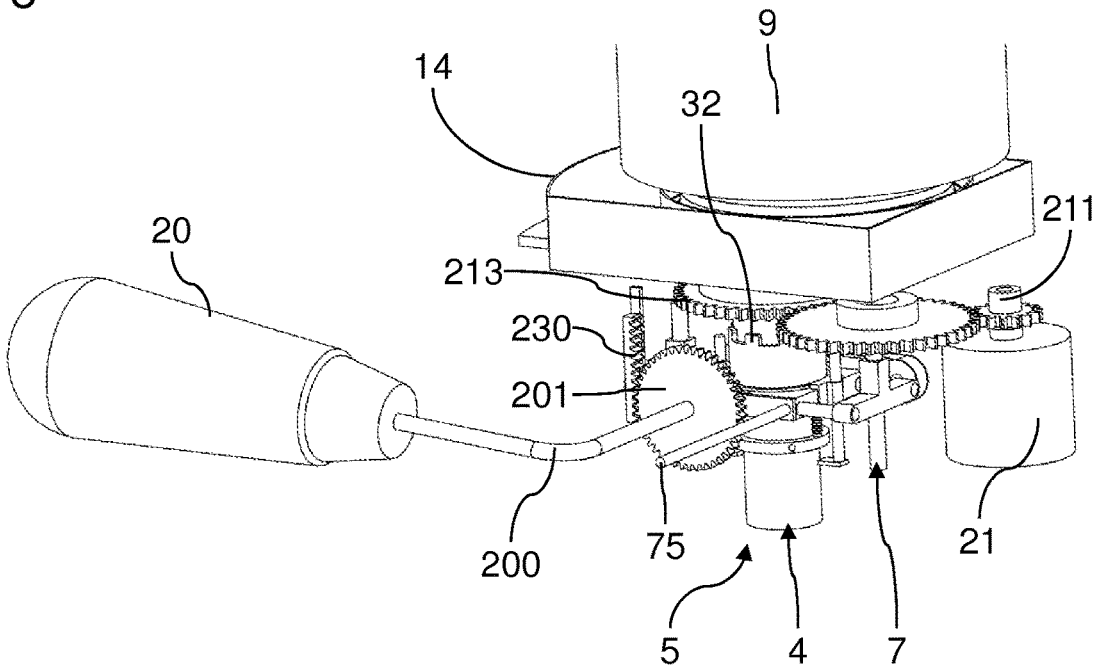
FIG. 8 is a perspective view of a certain number of components inside the machine.

FIG. 8 is a perspective view of a certain number of components of the machine 1. The machine 1 has in particular a manual actuator 75 which is accessible from outside the casing 10. The actuator 75 can, for example, slide in a groove formed through the casing 10. The actuator 75 is intended to apply a force to the support 7 so as to bring it into its position releasing the subassembly 5.

Figure 9:
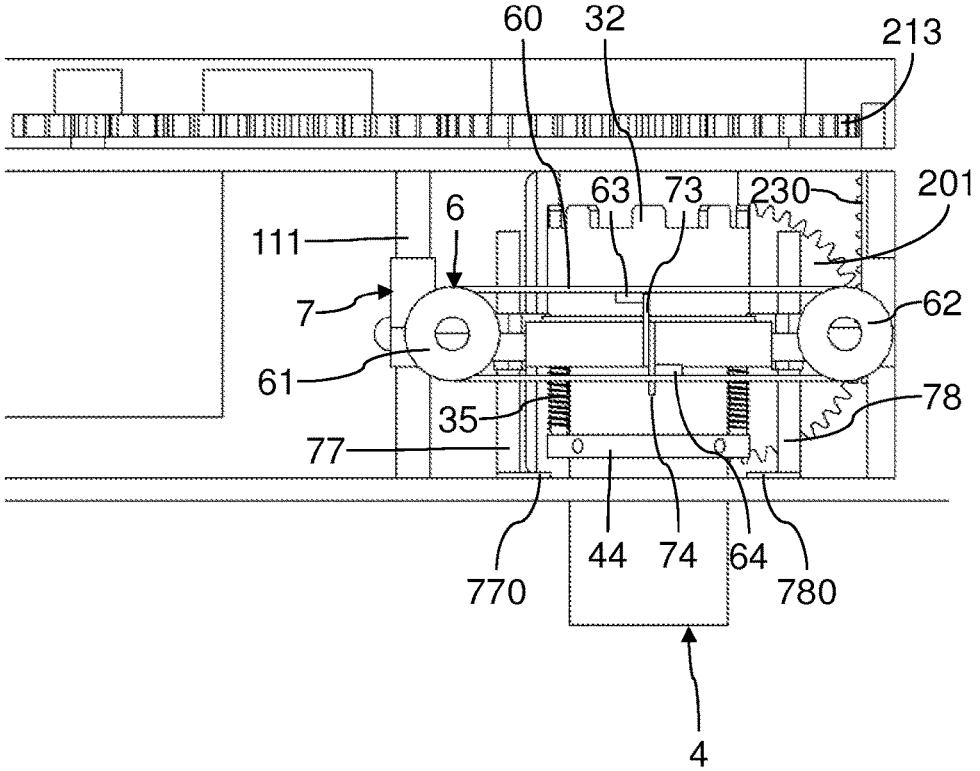
FIG. 9 is a side view of the support of the removable subassembly in the locked position.

FIG. 9 is a side view of the support of the removable subassembly 5 in the guide position, illustrating a mechanism 6 of the support 7 which allows it to move from the guide position of the subassembly to its release position. The mechanism 6 has two pulleys 61 and 62 mounted so that they can pivot on the support 7 about transverse axes. A belt 60 is wound about pulleys 61 and 62. A stud 63 is integral with the upper length of the belt 60. A protuberance 73 of the jaw 71 is fixed on the stud 63. A stud 64 is integral with the lower length of the belt 60. A protuberance 74 of the jaw 72 is fixed on the stud 64. Thus, when the actuator 75 tends to cause the jaw 71 to slide longitudinally, the protuberance 73 drives the stud 63 in the same translational movement. The stud 64, fixed on the opposite length, is driven in translation in an opposite direction to the stud 63. The stud 64 thus drives the protuberance 74 and hence the jaw 72 in translation in an opposite direction to that of the jaw 71.

The stops 77 and 78 have an L shape and thus have a rod-shaped part and an end which forms a longitudinal protuberance. The stop 77 thus has a protuberance 770 at the level of its lower end. The stop 78 has a protuberance 780 at the level of its lower end. The jaw 71 is mounted so that it can slide vertically with respect to the rod of the stop 77. The jaw 72 is mounted so that it can slide vertically with respect to the rod of the stop 78. The stops 77 and 78 are integral, when they slide longitudinally, with the jaws 71 and 72, respectively. The vertical position of the stops 77 and 78 is fixed with respect to the frame 11.

FIGS. 10 and 11 are plan perspective views of the support 7 in its configuration where it guides the stirrer 3 in rotation and maintains the vertical position of the stirrer 3. The stirrer 3 is here in its intermediate position, the teeth 32 not engaging with the inner teeth of the toothed wheel 213. The jaws 71 and 72 are maintained in a position applied flat against each other by return forces by means of springs (not illustrated). The vertical position of the stirrer 3 is ensured by a shoulder 37 formed on the outer periphery of the hollow shaft 31, interfering with the jaws 71 and 72. In this configuration, when the lever 20 is lowered, the stirrer 3 is brought toward its lower position. The protuberances 770 and 780 interfere with the collar 44, whereas the stirrer 3 continues its downward travel. The interference between the protuberances 770 and 780 and the collar 44 moves the bearing surface 33 away with respect to the piston of the plug 4, releasing the flow through the hollow shaft 31.

FIGS. 12 and 13 are plan perspective views of the support 7 in its configuration where it releases the stirrer 3 and the subassembly 5. By virtue of applying force to the actuator 75, the jaws 71 and 72 are moved apart from each other in order to enlarge the opening 70 formed between the jaws 71 and 72. In this configuration, the jaws 71 and 72 release the stirrer 3. The protuberances 770 and 780 are then moved away sufficiently that they do not interfere with the collar 44. Consequently, the subassembly 5 is then free to slide vertically and can be withdrawn from the machine 1. The subassembly 5 can then be cleaned easily.

The support 7 equipped with the jaws 71 and 72 which are stressed by return springs advantageously makes it possible to refit the subassembly 5 by clipping it into place. The stirrer 3 can thus be reinserted by sliding it through the opening 70 formed between the jaws 71 and 72. By continuing the vertical sliding of the stirrer 3, the shoulder 37 interferes with the jaws 71 and 72 in order to move them apart. Once the shoulder 37 has passed the jaws 71 and 72, the latter are stressed by the springs in order to narrow the opening 70 and be positioned below the shoulder 37. The stirrer 3 is then again maintained in a vertical position.

The control circuit can implement a certain number of safety measures to prevent problems during use. A sensor can, for example, detect the upper position of the stirrer 3 or the lever 20 and thus influence the driving of the stirrer 3 by the motor 21 to this upper position. The control circuit can comprise a time delay for the driving by the motor 21, corresponding to a sufficient period of time for cooling the beverage in the can 9.

Figure 14:
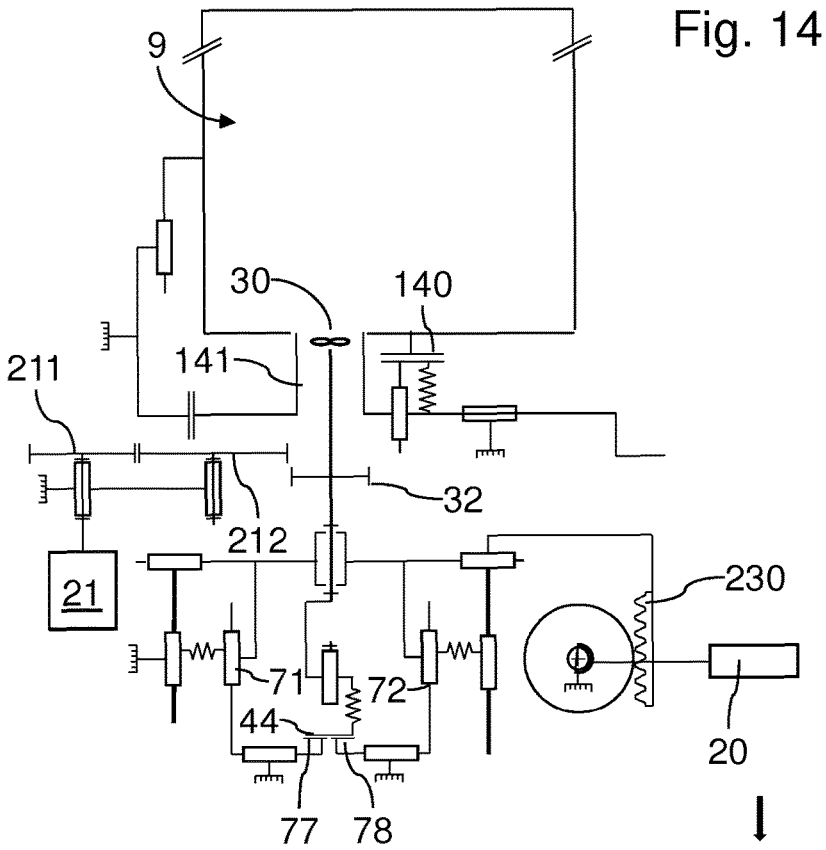
FIGS. 14 to 19 illustrate the kinematics of the machine in different operating phases.

FIGS. 14 to 19 illustrate the kinematics of the machine 1 for different phases of its operation. For the sake of legibility, a certain number of components have not been illustrated. FIG. 14 illustrates the machine 1 when the can 9 is inserted into the refrigerated housing. The can 9 is brought into contact with the seal 140. The subassembly 5 is held by the jaws 71 and 72 of the support 7. The fins 30 of the stirrer 3 are set back with respect to the tube 141, the stirrer being maintained in its intermediate position by the lever 20. The teeth 32 of the stirrer 3 are disengaged with respect to the intermediate gear system 212 and hence with respect to the motor 21.

Figure 15:
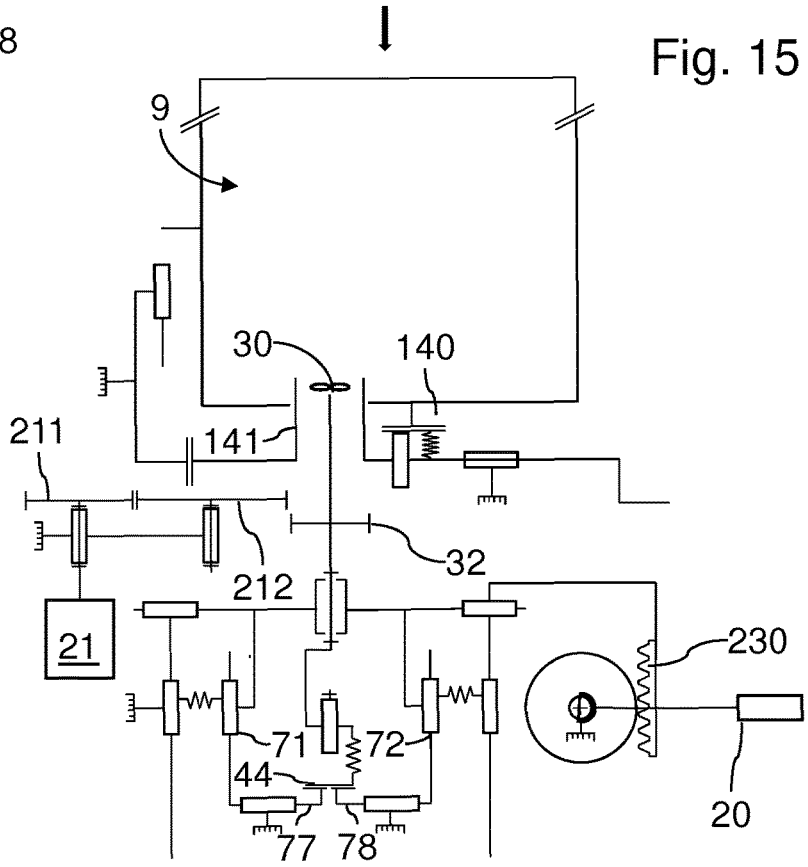

FIG. 15 illustrates the machine 1 when the cover 13 is closed. The top end of the can 9 is then pierced by the tube 141 and pushes the seal 140 downward. The beverage present inside the can flows through the hollow shaft 31 as far as the plug 4 which is maintained in its blocking position.

Figure 16:
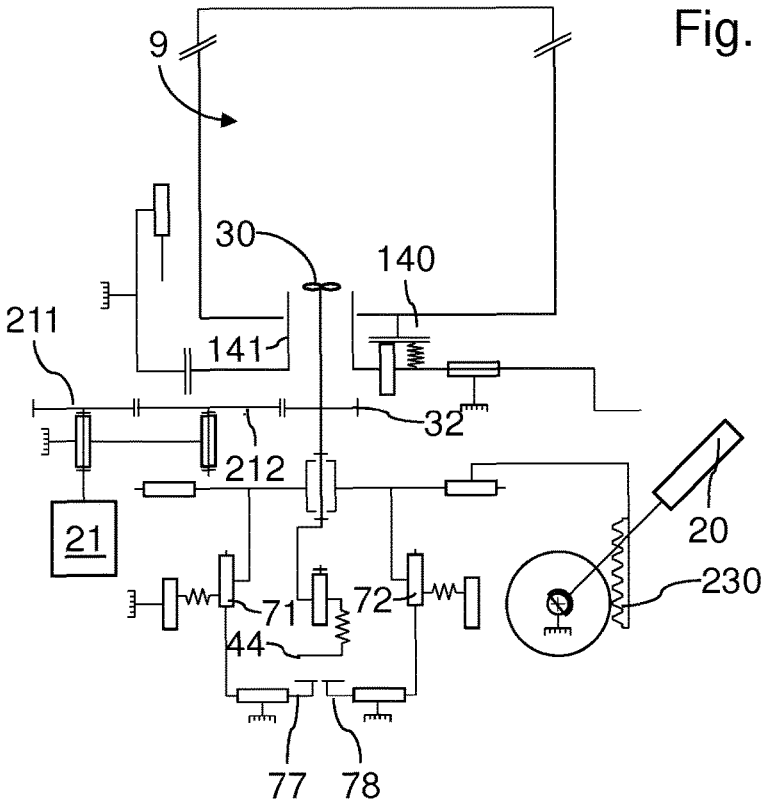

FIG. 16 illustrates the machine 1 when the lever 20 is raised. The jaws 71 and 72 of the support then slide upward and cause the fins 30 of the stirrer to slide upward. The fins 30 then project above the tube 141, inside the can 9. The stirrer 3 is guided in rotation by the jaws 71 and 72. The teeth 32 then engage with the intermediate toothed wheel 212. The motor 21 is then controlled so as to drive the fins 30 in rotation by means of the teeth 32. The plug 4 remains integral with the stirrer 3 and maintained in its blocking position.

Figure 17:
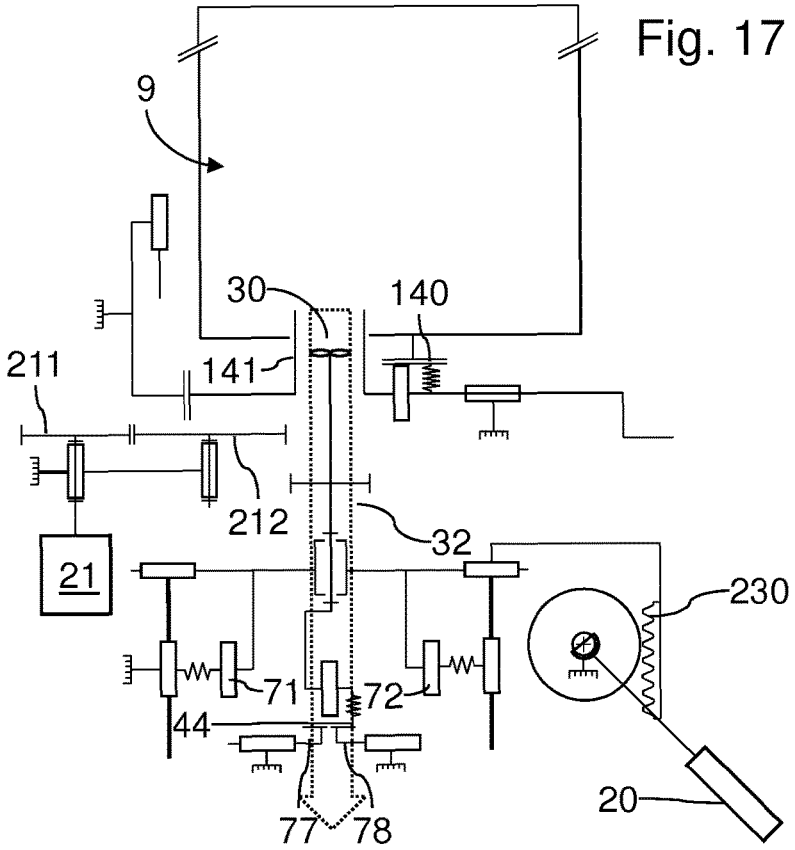

FIG. 17 illustrates the machine 1 when the lever 20 is lowered. The driving in rotation by the motor 21 is first interrupted and the teeth 32 are disengaged with respect to the intermediate toothed wheel 212. The fins 30 are positioned so that they are set back inside the tube 141. The collar 44 interferes with the stops 77 and 78 in order to drive the plug 4 into its open position. The beverage can then flow through the hollow shaft 31.

Figure 18:
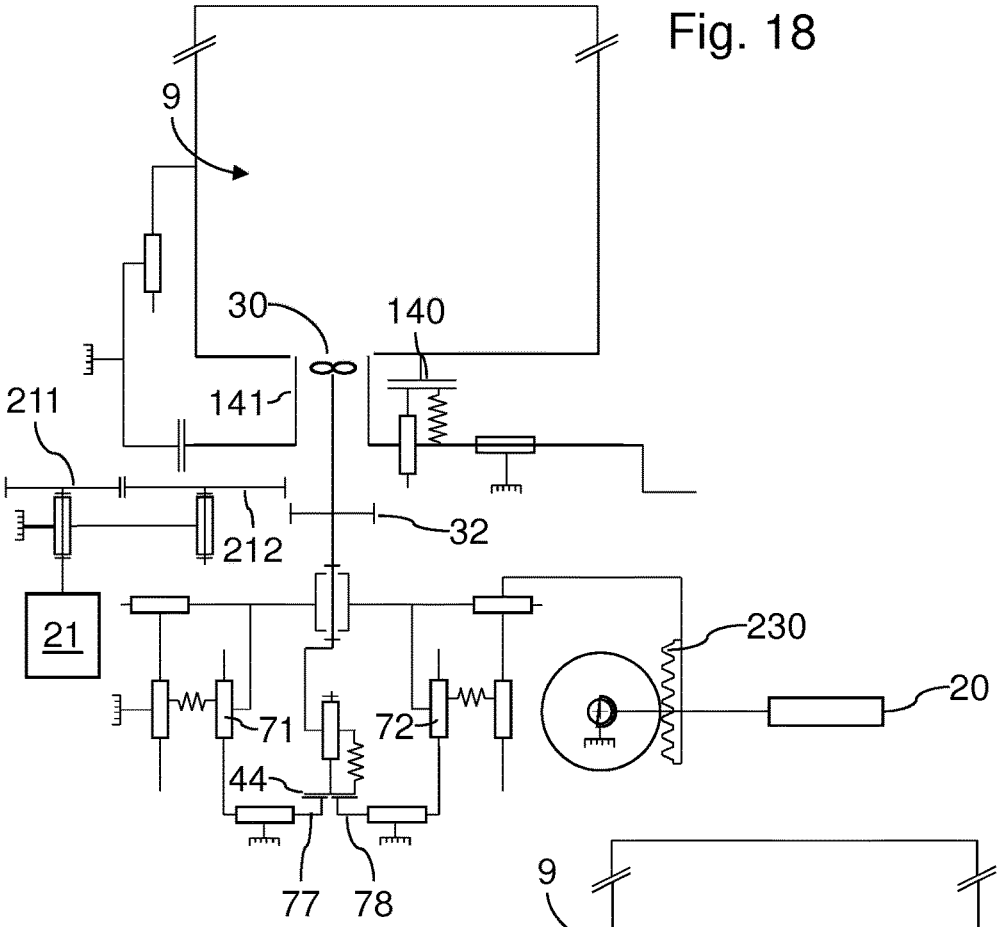

FIG. 18 illustrates the machine when the lever 20 is brought toward a neutral position. The can 9 can be withdrawn from the refrigerated housing and its top end slides with respect to the tube 141. The stirrer 3 is in its intermediate position and the plug 4 has returned to its blocking position.

Figure 19:
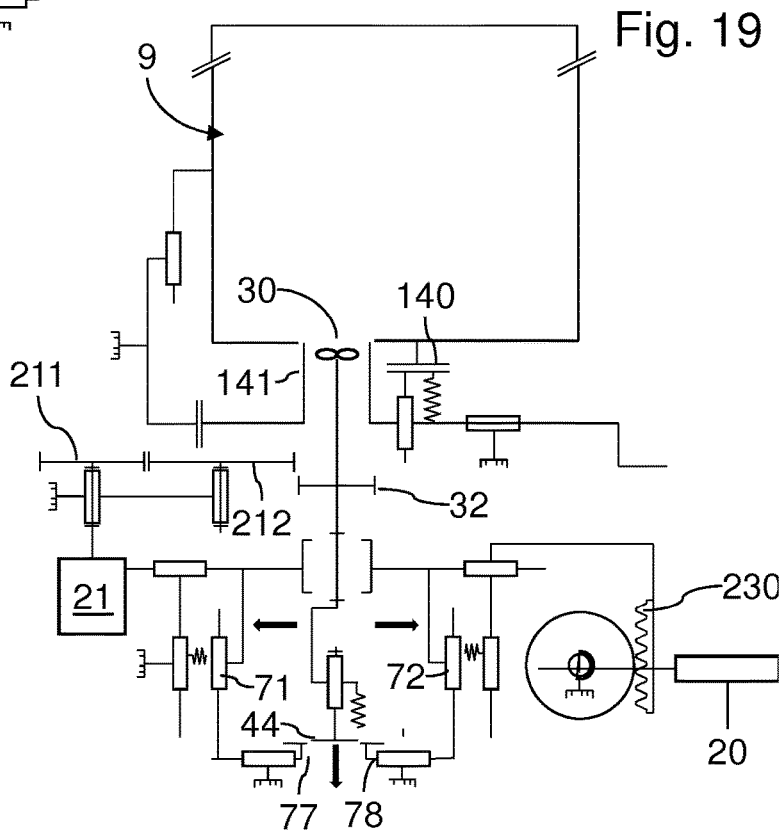

FIG. 19 illustrates the machine when the subassembly 5 is withdrawn. The jaws 71 and 72 are moved apart from each other by means of the lever 75 such that the subassembly 5 is no longer held by the jaws 71 and 72. The stops 77 and 78 are also moved apart such that the collar 44 no longer interferes with them. The subassembly 5 can subsequently slide downward due to gravity or by virtue of force applied by a user and can hence be separated from the remainder of the machine 1 so that it can, for example, be rinsed in running water.

The invention claimed is:

1. A machine (1) for cooling and draining contents of a metal beverage can (9), the machine comprising:
- a refrigerated housing (120) to receive the can;
- a tube (141) projecting into the refrigerated housing (120) and defining a bore (142);
- a removable subassembly (5) including:
  - a rotatable stirrer (3) mounted to slide with respect to the tube (141) to pass through the bore (142) between an upper position in which the stirrer projects above an upper edge of the tube and a position in which the stirrer is set back with respect to the upper edge of the tube;
  - a duct (31) having an outlet orifice (312) and an inlet orifice (311) communicating with the bore;
  - a plug (4) blocking or opening selectively the outlet orifice of the duct.

2. The machine (1) as claimed in claim 1, furthermore comprising a seal (140) arranged in the refrigerated housing (120) and enclosing the tube (141).

3. The machine (1) as claimed in claim 2, in which the seal (140) and said tube (141) are fixed in a removable slide (14).

4. The machine (1) as claimed in claim 1, wherein the upper edge of the tube (141) is a cutting.

5. The machine (1) as claimed in claim 1, furthermore comprising a cover (13) mounted to pivot via a first end (131) at a level of an upper end of the refrigerated housing (120) and having a gripping means (133) at a level of a second end (132), the cover having a part which projects into the refrigerated housing when a force is applied to the gripping means such that the cover covers the refrigerated housing.

6. The machine (1) as claimed in claim 1, comprising an electric motor (21) driving a gear system (211, 212, 213) in rotation, the stirrer (3) engaging with the gear system in a position in which the stirrer projects above the upper edge of the tube (141) and disengaged from the gear system in a position in which the stirrer is set hack with respect to the upper edge of the tube.

7. The machine (1) as claimed in claim 6, in which the stirrer (3) comprises a hollow shaft (31) which defines the duct, the hollow shaft having teeth (32) which selectively engage with the gear system.

8. The machine (1) as claimed in claim 7, in which the stirrer (3) has fins (30) fixed to an upper end of the hollow shall (31).

9. The machine (1) as claimed in claim 1, comprising first and second jaws (71, 72) which can move in translation between a position in which the subassembly (5) is guided in rotation and a position in which the subassembly is released to slide vertically.

10. The machine (1) as claimed in claim 9, in which the first and second movable jaws (71, 72) are stressed elastically toward a position in which the subassembly (5) is guided in rotation.

11. The machine (1) as claimed in claim 10, furthermore comprising:

an actuator (75) integral with the first jaw (71) to drive the first jaw-toward a position in which the first jaw is released to slide vertically;

a belt (60) having a first length integral with the first jaw and a second length integral with the second jaw (72).

12. The machine (1) as claimed in claim 1, in which:

the plug (4) is mounted to slide vertically with respect to the duct (31) between a position in which the plug (4) blocks the outlet orifice and a position in which the plug (4) opens the outlet orifice, the plug (4) being stressed elastically toward a position in which the outlet orifice is opened;

the stirrer (3) is integral with the duct (31) and is mounted so that the stirrer can slide with respect to the tube (141) as far as a lower position in which the stirrer can continue to travel but in which the plug interferes with a stop (770, 780) to move into a position in which the outlet orifice is opened.

13. The machine (1) as claimed m claim 12, in which a actuator (75) is integral with the stop (770, 780) such that the stop no longer interferes with the plug (4) when the actuator drives the first jaw (71) toward a position in which the first jaw (71) is released to slide vertically.

14. The machine (1) as claimed in claim 13, furthermore comprising a pivoting lever (20) which drives a toothed wheel (201) in rotation, the toothed wheel (201) meshing with a rack (230) integral with the stirrer (3) such that pivoting of the lever (20) toward a first position drives the stirrer toward an upper position, pivoting of the lever toward a second position drives the stirrer toward an intermediate position in which the stirrer is set back with respect to the upper edge of the tube (141), and pivoting of the lever toward a third position drives the stirrer (3) toward a lower position.

15. A machine (1) for cooling and draining contents of a metal beverage can (9), the machine comprising:

a refrigerated housing (120) to receive a can;

a tube (141) projecting into the refrigerated housing (120) and defining a bore (142);

a removable slide (14) having a seal (140), the tube (141) passing through the seal;

a removable subassembly (5) including:

a stirrer (3) mounted to slide with respect to the tube (141) to pass through the bore (142) between an upper position in which the stirrer projects above an upper edge of the tube and a position in which the stirrer is set back with respect to the upper edge of the tube;

a duct (31) having an outlet orifice (312) and an inlet orifice (311) communicating with the bore;

a plug (4) blocking or opening selectively the outlet orifice of the duct.

16. A machine (1) for cooling and draining contents of a metal beverage can (9), the machine comprising:

a refrigerated housing (120) to receive a can;

a tube (141) projecting into the refrigerated housing (120) and defining a bore (142);

a removable subassembly (5) including:

a stirrer (3) mounted to slide with respect to the tube (141) to pass through the bore (142) between an upper position in which the stirrer projects above an upper edge of the tube and a position in which the stirrer is set back with respect to the upper edge of the tube;

a duct (31) having an outlet orifice (312) d an inlet orifice (311) communicating with the bore;

a plug (4) blocking or opening selectively the outlet orifice of the duct;

first and second jaws (71, 72) adaptable to move in translation between a position in which the subassembly (5) is guided in rotation and a position in which the subassembly is released to slide vertically, and wherein the first and second movable jaws (71, 72) are stressed elastically toward the position in which the subassembly (5) is guided in rotation.

* * * * *